US006487877B1

(12) United States Patent
Griffiths et al.

(10) Patent No.: US 6,487,877 B1
(45) Date of Patent: Dec. 3, 2002

(54) NITROGEN GENERATION PROCESS

(75) Inventors: John Louis Griffiths, Pittsburgh, PA (US); Adam Adrian Brostow, Emmaus, PA (US); Declan Patrick O'Connor, Chessington (GB); Swaninathan Sunder, Allentown, PA (US); Patrick Alan Houghton, Emmaus, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 10/136,999

(22) Filed: May 1, 2002

(51) Int. Cl.[7] ..... F25J 3/00

(52) U.S. Cl. ..... 62/643; 62/637; 62/908; 62/913

(58) Field of Search ..... 62/637, 908, 913, 62/643

(56) References Cited

U.S. PATENT DOCUMENTS

| | | | | |
|---|---|---|---|---|
| 3,109,726 A | * | 11/1963 | Karwat | 62/637 |
| 3,363,427 A | * | 1/1968 | Blanchard et al. | 62/913 |
| 3,739,593 A | * | 6/1973 | Schauls | 62/908 |
| 4,038,060 A | * | 7/1977 | Kamiya et al. | 62/908 |
| 5,711,166 A | | 1/1998 | Mehta et al. | 62/650 |
| 6,202,442 B1 | | 3/2001 | Brugerolle | 62/649 |
| 6,276,171 B1 | | 8/2001 | Brugerolle | 62/646 |

FOREIGN PATENT DOCUMENTS

| | | | |
|---|---|---|---|
| WO | WO00/60294 | 10/2000 | F25J/3/04 |

* cited by examiner

*Primary Examiner*—Ronald Capossela
(74) *Attorney, Agent, or Firm*—Willard Jones II

(57) ABSTRACT

A process for producing a nitrogen-enriched vapor product from a supply of a nitrogen-rich liquid uses a purifying device and a distillation column having a distillation zone. The process includes the steps of: feeding at least a portion of the supply of the nitrogen-rich liquid to the distillation zone at a first location; feeding a stream of a gas containing nitrogen and at least one contaminant to the purifying device, wherein the gas is cooled by a cryogenic liquid whereby at least a portion of the at least one contaminant condenses, solidifies, or dissolves; eventually feeding at least a portion of the cool gas from the purifying device to the distillation zone at a second location below the first location; withdrawing a stream of the nitrogen-enriched vapor product from the distillation zone; and withdrawing a stream of an oxygen-enriched liquid from the distillation zone.

12 Claims, 7 Drawing Sheets

NITROGEN GENERATION PROCESS

BACKGROUND OF THE INVENTION

The present invention relates generally to processes for the cryogenic distillation of air, and in particular to such processes used to produce at least a nitrogen-enriched vapor product.

Nitrogen is one of the most important industrial gases. A common way to supply nitrogen to a process or a customer is a customer station. Typically, liquid nitrogen is hauled in a tanker from a cryogenic air separation plant or a liquefier to the customer's site, stored in a tank, optionally pumped to a desired pressure, and vaporized in an ambient vaporizer. This process is thermodynamically very inefficient. However, the equipment is inexpensive and reliable.

Another common process to produce nitrogen on a customer's site is a cryogenic air separation unit. Air is purified to remove water, $CO_2$, $N_2O$, and other contaminants that may freeze in a cryogenic distillation column, cooled in a heat exchanger to close to its cryogenic saturation temperature (a temperature at which it starts liquefying after the bulk of contaminants is removed), and separated in a cryogenic distillation column into a nitrogen product and an oxygen-rich product. Cooling takes place against returning product streams. This process is thermodynamically very efficient but the equipment is expensive. Refrigeration is supplied by isentropic expansion of one of the streams in a turbine, or, as a less expensive alternative, by liquid nitrogen injection. Liquid nitrogen injection requires hauling liquid nitrogen to the site and storing the liquid nitrogen in a tank. A customer station is usually required as a backup system.

"Cryogenic saturation" refers to the state of a gas when, if cooled, a portion of the gas is converted to a liquid. This liquid comprises the major components contained in the cryogenically saturated gas. This is different than ambient saturation, in which the resultant liquid comprises the minor components and/or impurities contained in the vapor.

A "cryogen" refers to a liquid that normally exists at "cryogenic temperatures," which are defined as temperatures below −110° F.

U.S. Pat. No. 6,202,422 (Brugerolle) discloses an air separation unit integrated with a gas turbine. This patent discloses a nitrogen wash column wherein liquid nitrogen is pumped to the top of the column and air from a gas turbine compressor is purified to remove water, $CO_2$, and other contaminants that may freeze in a cryogenic distillation column. The purified air is cooled to a temperature close to its cryogenic saturation temperature, and is then introduced to the bottom of the column. Air from the gas turbine compressor is at a relatively high pressure, which reduces purification equipment cost. Gaseous nitrogen product is recovered from the top of the column, warmed against a feed air stream, and subsequently used in the gas turbine.

U.S. Pat. No. 6,276,171 (Brugerolle) and WO 00/60294 (Brugerolle) disclose a nitrogen wash column integrated with an air separation unit. Air to the column may come from a separate compressor. The air is purified by removing water, $CO_2$ and other contaminants that may freeze in a cryogenic distillation column, and the purified air is cooled against a nitrogen product in a separate heat exchanger. The purposes of the system and process are: 1) to increase oxygen and nitrogen production of the air separation unit, and 2) to be able to operate the air separation unit and the nitrogen wash column independently of one another. For example, when the air separation unit is down, liquid nitrogen to the nitrogen wash column comes from a tank. Oxygen-rich liquid can be stored in another tank and returned to the air separation unit when it is back on line. Separate heat exchangers, compressors, and air purifiers help accomplish this task. This process is a variation of the thermodynamically efficient cryogenic air separation process discussed previously.

There are many methods commonly used in the industry to purify air fed to an air separation unit such as a nitrogen wash column. One is a molecular sieve or activated alumina adsorber unit, which adsorbs water, $CO_2$, $N_2O$, and other contaminants that may freeze in the heat exchanger. It requires a low-pressure gas stream for regeneration. Another method is a reversing heat exchanger or a regenerator. Contaminants freeze out in a heat exchanger that cools incoming air from close-to-ambient temperature to close-to-cryogenic saturation temperature by exchanging heat with cryogenic vapor product or products. One unit is on stream while another is being regenerated. An adsorber unit with or without a heat exchanger, or a reversing heat exchanger, is expensive.

It is desired to have an improved process for the production of a nitrogen-enriched vapor product.

It is further desired to have a more efficient process for the production of a nitrogen-enriched vapor product.

It is still further desired to have a more efficient and improved process for the production of a nitrogen-enriched vapor product which overcomes the difficulties and disadvantages of the prior art processes to provide better and more advantageous results.

BRIEF SUMMARY OF THE INVENTION

The invention is a process and a system for producing a nitrogen-enriched vapor product from a supply of a nitrogen-rich liquid. There are several variations of the process and several variations of the system.

The process, which uses a purifying device and a distillation column having a distillation zone, includes multiple steps. The first step is to feed at least a portion of the supply of the nitrogen-rich liquid to the distillation zone at a first location. The second step is to feed a stream of a gas containing nitrogen and at least one contaminant to the purifying device, wherein the gas is cooled by a cryogenic liquid whereby at least a portion of the at least one contaminant condenses, solidifies, or dissolves. The third step is to eventually feed at least a portion of the cool gas from the purifying device to the distillation zone at a second location below the first location. The fourth step is to withdraw a stream of the nitrogen-enriched vapor product from the distillation zone. The fifth step is to withdraw a stream of an oxygen-enriched liquid from the distillation zone.

In one variation of the process, at least a portion of the cryogenic liquid is at least a portion of the stream of the oxygen-enriched liquid. In another variation, the purifying device is located inside the distillation column, while in another variation, the purifying device is located outside the distillation column. In yet another variation, the gas containing nitrogen comprises air, while in another variation, the gas containing nitrogen has a composition different than a composition of atmospheric air.

The system for producing a nitrogen-enriched vapor product from a supply of a nitrogen-rich liquid includes multiple elements. The first element is a means for containing the supply of the nitrogen-rich liquid. The second element is a distillation column having a distillation zone inside the distillation column. The second element is a purifying device in fluid communication with the distillation column. The fourth element is a means for feeding at least a portion of the supply of the nitrogen-rich liquid to the distillation zone at a first location. The fifth element is a supply of a gas containing nitrogen and at least one contaminant. The sixth element is a means for eventually feeding a stream of the supply of the gas to the purifying device, wherein the gas is cooled by a cryogenic liquid whereby at least a portion of the at least one contaminant condenses, solidifies, or dissolves. The seventh element is a means for withdrawing a stream of the nitrogen-enriched vapor product from the distillation zone. The eighth element is a means for withdrawing a stream of an oxygen-enriched liquid from the distillation zone.

In one variation of the system, at least a portion of the cryogenic liquid is at least a portion of the stream of the oxygen-enriched liquid. In another variation, the purifying device is located inside the distillation column, while in another variation, the purifying device is located outside the distillation column. In yet another variation, the gas containing nitrogen comprises air, while in another variation, the gas containing nitrogen has a composition different than a composition of atmospheric air.

BRIEF DESCRIPTION OF SEVERAL VIEWS OF THE DRAWINGS

The invention will be described by way of example with reference to the accompanying drawings, in which.

DETAILED DESCRIPTION OF THE INVENTION

Figure 1:
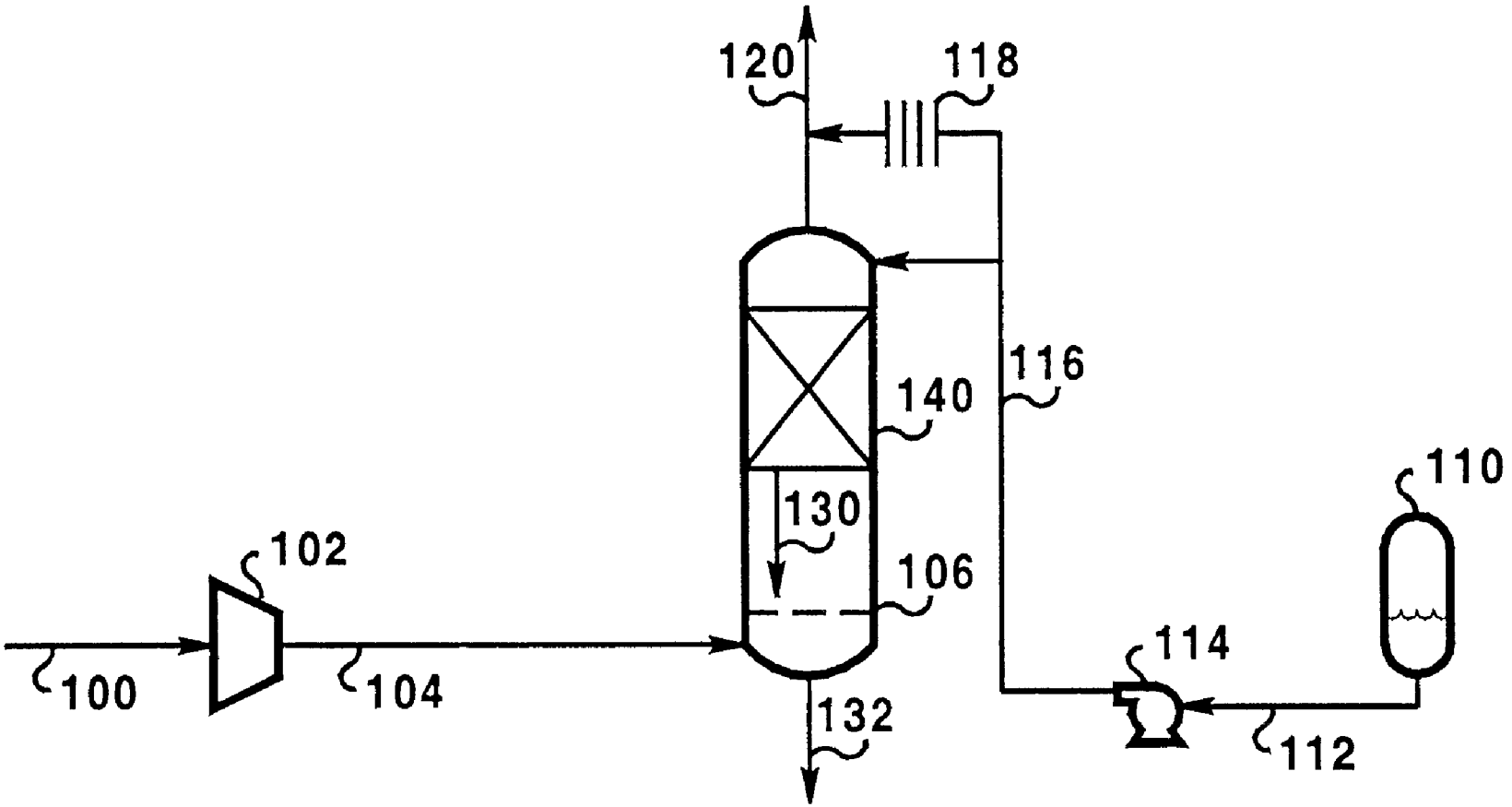
FIG. 1 is a schematic diagram of one embodiment of the present invention.

FIG. 1 shows one embodiment of the invention. A nitrogen-containing gas stream 100, which also contains oxygen, is a compressed in a compressor 102. The resulting compressed stream 104 may be cooled in an aftercooler or a chiller (not shown). Any condensate present at this point can be removed in a phase separator (not shown). Stream 104 is then fed to the bottom of a cryogenic distillation column 140 where stream 104 comes into direct contact with a first oxygen-enriched liquid stream 130 from the distillation zone of the distillation column and vaporizes a portion of the oxygen-enriched liquid. Any contaminants present in stream 104 are at least partially condensed, solidified, or dissolved in a purifying device 106, which has components that may include, but are not limited to, trays, structured packing, random packing, vapor spargers, spray nozzles, screens, strainers, filters, or demisters, employed individually or in combination. The purifying device may also improve heat and/or mass transfer on the bottom of the distillation column and may perform part of the distillation separation. A nitrogen-rich liquid stream 112 withdrawn from a storage tank 110 is pumped to a higher pressure in a pump 114 before being introduced to the top of the distillation column 140 as stream 116. Nitrogen-enriched vapor product stream 120 is withdrawn from the top of the distillation column. A second oxygen-enriched liquid is withdrawn from the bottom of the distillation column and is discarded as stream 13, which contains at least a portion of any contaminants present in the nitrogen-containing gas stream 104. These contaminants may include, but are not limited to, water, $CO_2$, $N_2O$, and hydrocarbons.

Primary contact devices that perform distillation in the distillation zone of the distillation column 140 may include, but are not limited to, structured packing, random packing, distillation trays, liquid spray in direct contact with vapor, or a combination of such devices.

When the distillation column 140 is not in operation, the purifying device 106 and the rest of the distillation column can be cleaned or defrosted by blowing through the distillation column nitrogen-containing gas from the compressor 102. Bypassing the compressor aftercooler (not shown) may be used to control the temperature of the nitrogen-containing gas stream 104.

An optional vaporizer 118 may be used to directly vaporize at least a portion of the nitrogen-rich liquid stream 112 to produce at least a portion of the gaseous product in the nitrogen-enriched vapor stream 120. The vaporizer also may be used when the distillation column 140 is not in operation or to supplement the distillation column product. The vaporizer type may include, but is not limited to, an ambient or water bath vaporizer.

Figure 2:
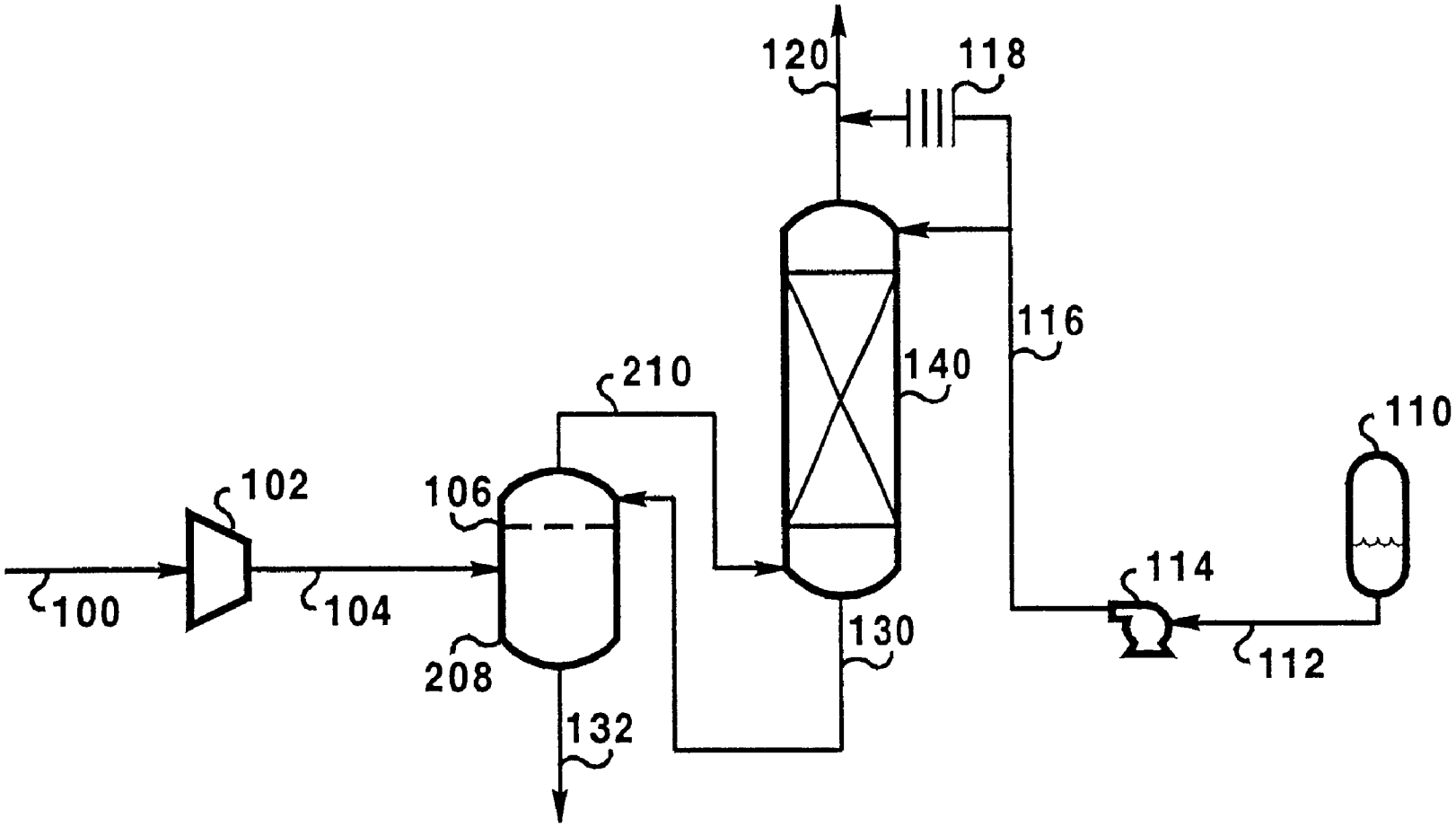
FIG. 2 is a schematic diagram of a second embodiment of the present invention.

FIG. 2 illustrates another embodiment of the invention. For simplicity, the unchanged equipment and stream numbers from FIG. 1 have been retained in FIG. 2. Compressed nitrogen-containing gas stream 104 comes into contact with the first oxygen-enriched liquid stream 130 from the distillation column 140 in a vessel 208 that contains the purifying device 106. The resulting purified vapor stream 210 is fed to the distillation column. Stream 210 is colder than stream 104. Ideally, stream 210 is at its cryogenic saturation temperature. The second oxygen-enriched liquid is discarded in stream 132, which contains at least a portion of any contaminants. Stream 130 may be pumped if necessary.

Contaminants collecting in the vessel 208 or on the components of the purifying device 106 can be removed either continuously or periodically. This may be done by taking the unit off line and blowing it clean with nitrogen-containing gas from the compressor 102 or with another gas, or by other means. Two switching vessels may be employed. Also, vessel 208 may be placed inside the distillation column 140, preferably under the distillation zone.

Figure 3:
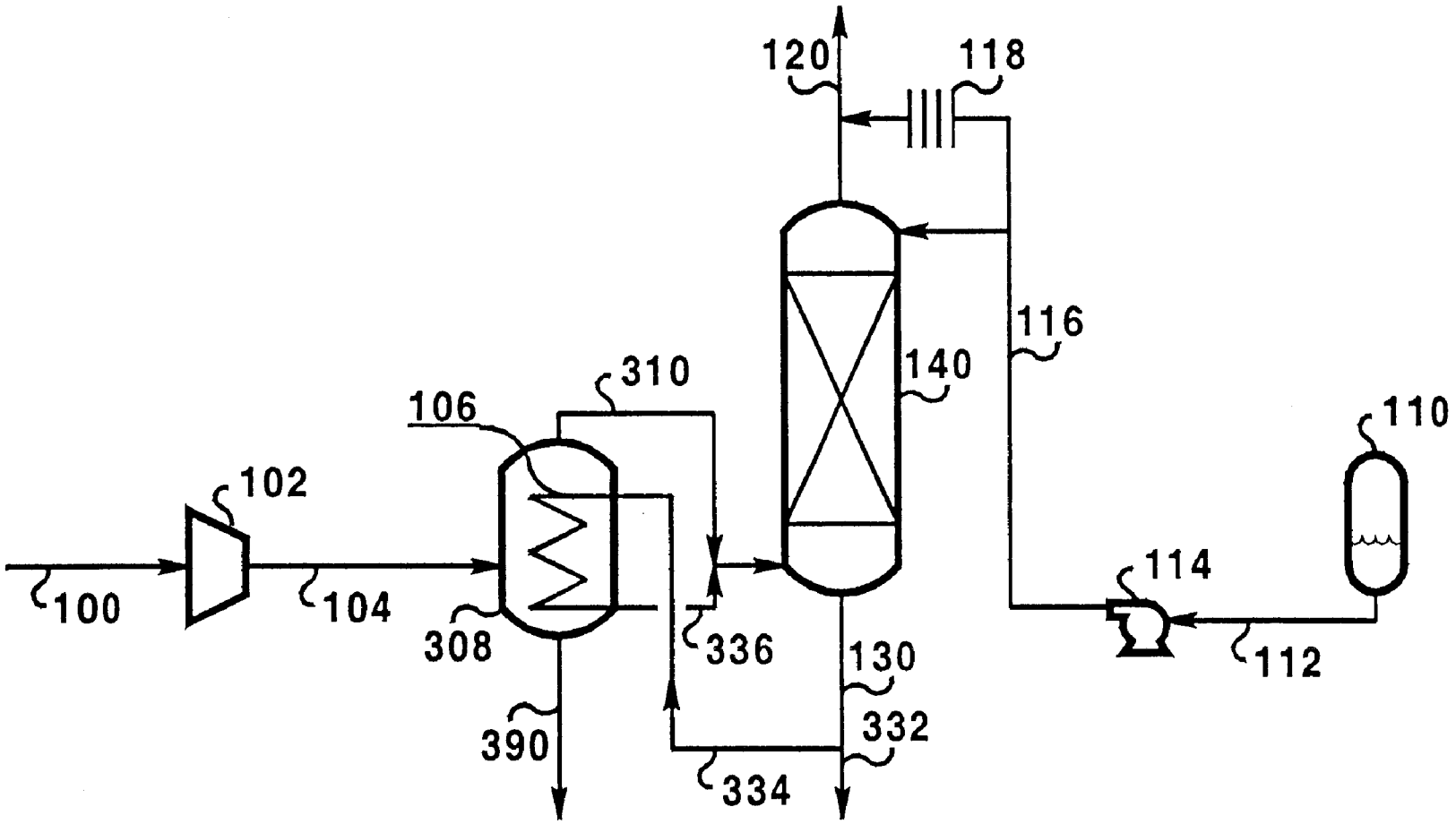
FIG. 3 is a schematic diagram of a third embodiment of the present invention.

FIG. 3 shows another embodiment of the invention. Compressed nitrogen-containing gas stream 104 is cooled in the purifying device 106 within a vessel 308 by indirect heat exchange with stream 334, which is a portion of the first oxygen-enriched liquid stream 130. Any contaminants in stream 104 are at least partially condensed or solidified. The resulting purified stream 310 is fed to the distillation column 140. Another portion of stream 130, stream 332, is discarded. Stream 334 is at least partially vaporized and returned back to the distillation column 140 as stream 336. If stream 334 is only partially vaporized, then the liquid portion 390 may also be discarded while the vapor portion is returned to the distillation column. It also is possible to put the entire stream 130 through the purifying device 106 and then discard the liquid portion and return the vapor portion to the distillation column. This may require the use of a phase separator or a standpipe (not shown).

As an alternative, the cooling utility stream 334 may not be a portion of stream 130, but another cryogenic fluid, for example, at least a portion of the nitrogen-rich liquid stream 116. Resulting nitrogen-rich vapor can be combined with the nitrogen-enriched vapor product stream 120.

As shown in FIG. 3, the purifying device 106 is contained within the vessel 308. The heat transfer surface of the purifying device can be a simple or concentric coil, or a more complex heat exchanger. It also could be a device known in the industry as a vapor recovery system. Other components of the purifying device may include, but are not limited to, screens, strainers, filters, or demisters, employed individually or in combination. Contaminants collecting in the vessel 308 or on the components of the purifying device 106 can be removed either continuously or periodically. This may be done by taking the unit off line and blowing it clean with nitrogen-containing gas from the compressor 102 or with another gas, or by other means. Two switching purifiers may be employed. Also, vessel 308 may be placed inside the distillation column 140, preferably under the distillation zone of the distillation column.

Figure 4:
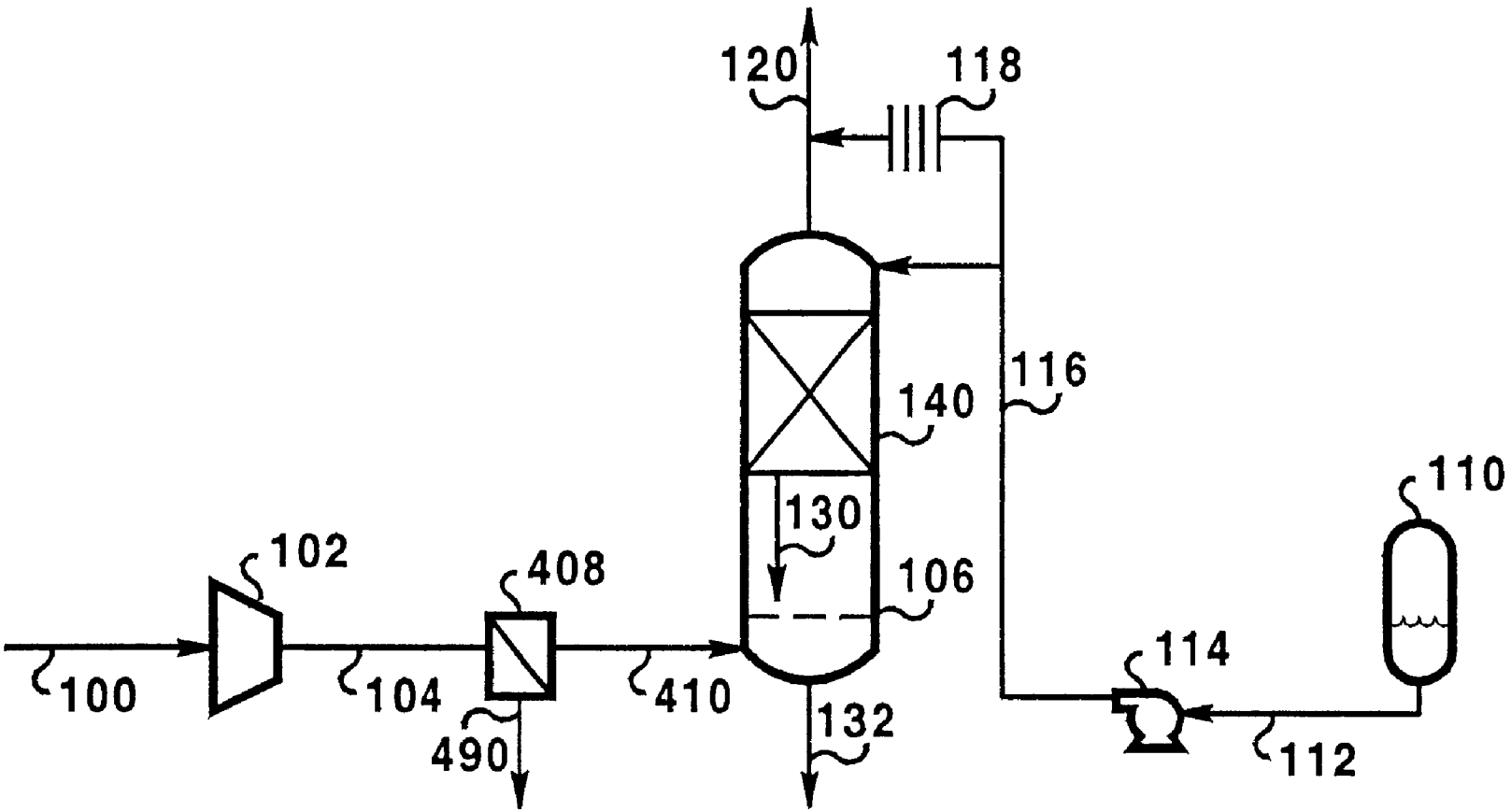
FIG. 4 is a schematic diagram of a fourth embodiment of the present invention.

FIG. 4 illustrates another embodiment of the invention. Compressed nitrogen-containing gas stream 104 goes through a prepurifier 408 prior to being introduced to the distribution column 140 as stream 410. The prepurifier removes in stream 490 the bulk of the water that may be present in stream 104. The prepurifier type used may include, but is not limited to, a membrane. The prepurifier also may be used to enrich stream 104 in nitrogen by rejecting a portion of the oxygen. It can be used for both water removal and nitrogen enrichment. Multiple prepurifiers can be used. Other contaminants, such as $CO_2$ or $N_2O$, are removed in the purifying device 106, which may be placed inside or outside of the distillation column 140. The type of purifying device may be any of the previously described types.

Figure 5:
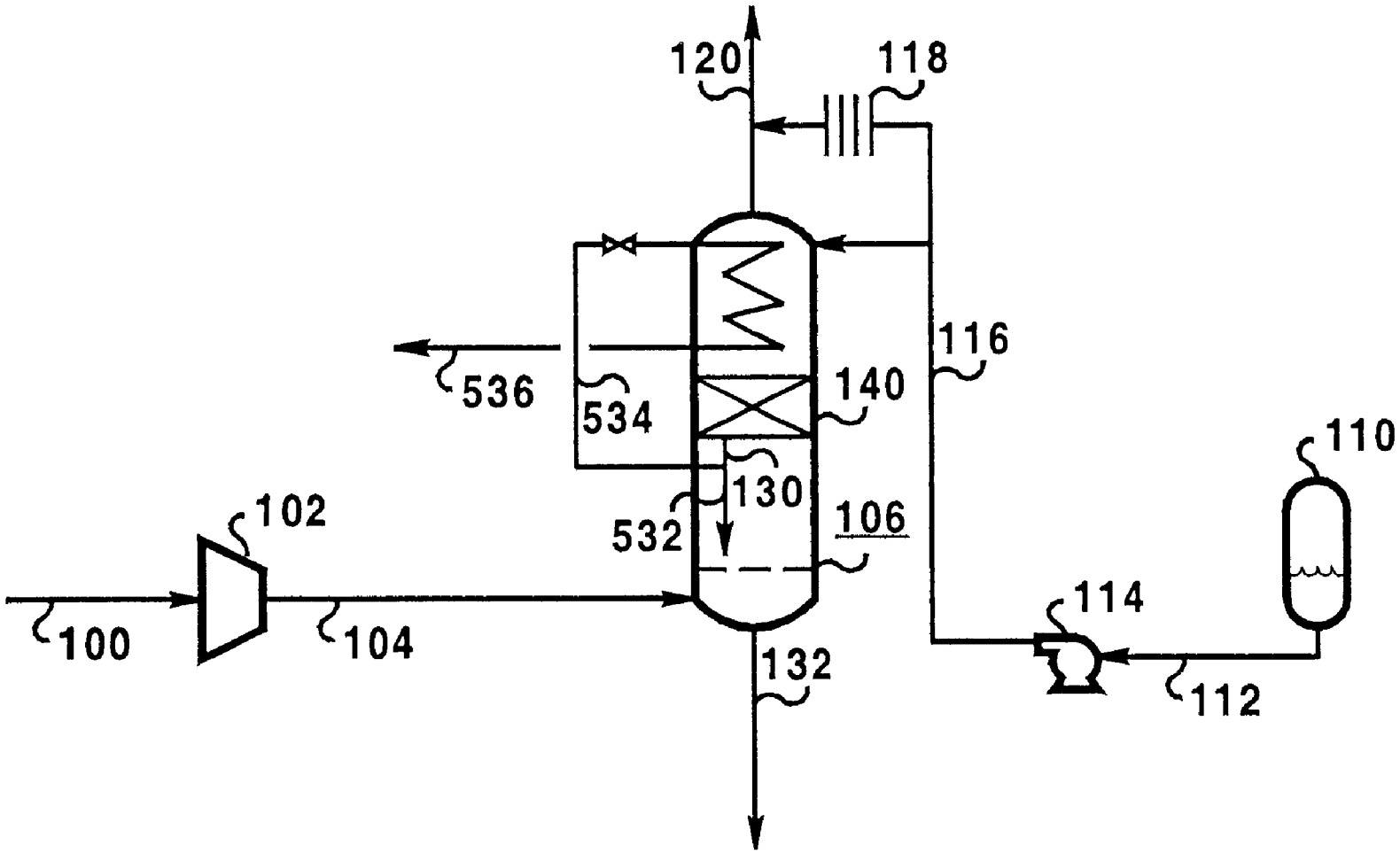
FIG. 5 is a schematic diagram of a fifth embodiment of the present invention.

FIG. 5 illustrates another embodiment of the invention which uses a distillation column 140 with a condenser. Cryogenic liquid stream 534, a portion of the first oxygen-enriched liquid stream 130 produced in the distillation zone of the distillation column 140, is reduced in pressure and at least partially vaporized against condensing vapor from the top of the distillation zone to produce stream 536. A different cryogenic fluid also can be used as cooling utility. Condensation can take place inside of the distillation column or in a separate vessel. Condensate is returned back to the distillation column or to a storage vessel such as storage tank 110.

The type of condenser used may include, but is not limited to, a shell-and-tube heat exchanger, a plate-and-fin heat exchanger, a brazed core, or a simple device similar to those used to recondense vapors in a tank. It could be a single or concentric coil, or a finned tube.

Figure 6:
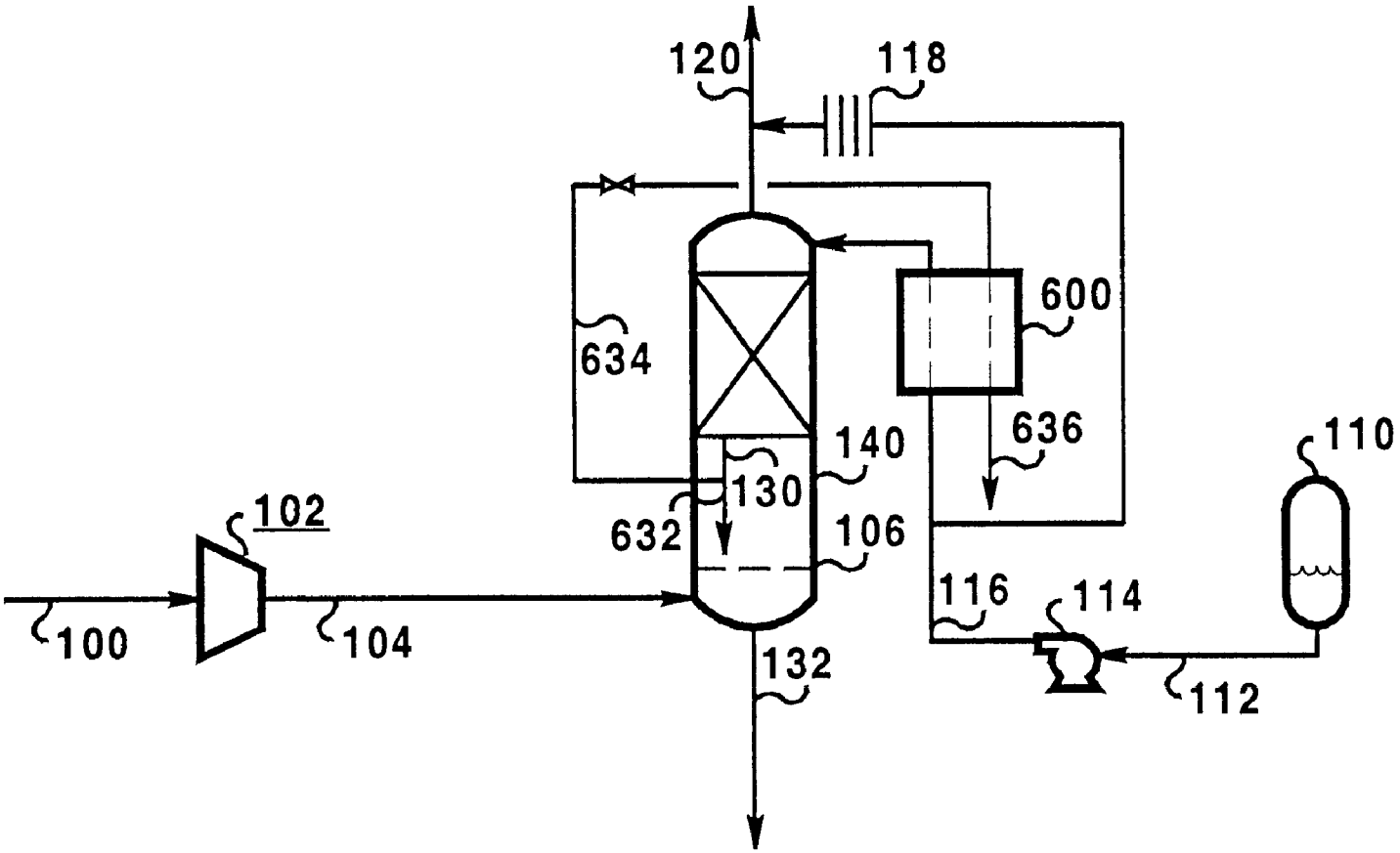
FIG. 6 is a schematic diagram of a sixth embodiment of the present invention.

FIG. 6 illustrates another embodiment of the invention which uses a distillation column 140 with a subcooler 600. Cryogenic liquid stream 634, a portion of the first oxygen-enriched liquid stream 130 produced in the distillation zone of the distillation column 140, is reduced in pressure and at least partially vaporized in the subcooler 600 to produce stream 636. A different cryogenic fluid also can be used as cooling utility. Nitrogen-rich liquid stream 116 is subcooled in the subcooler by indirect heat exchange with stream 634 prior to being introduced into the distillation column 140. The type of subcooler used may include, but is not limited to, a shell-and-tube heat exchanger, a plate-and-fin heat exchanger, or a brazed core.

Figure 7:
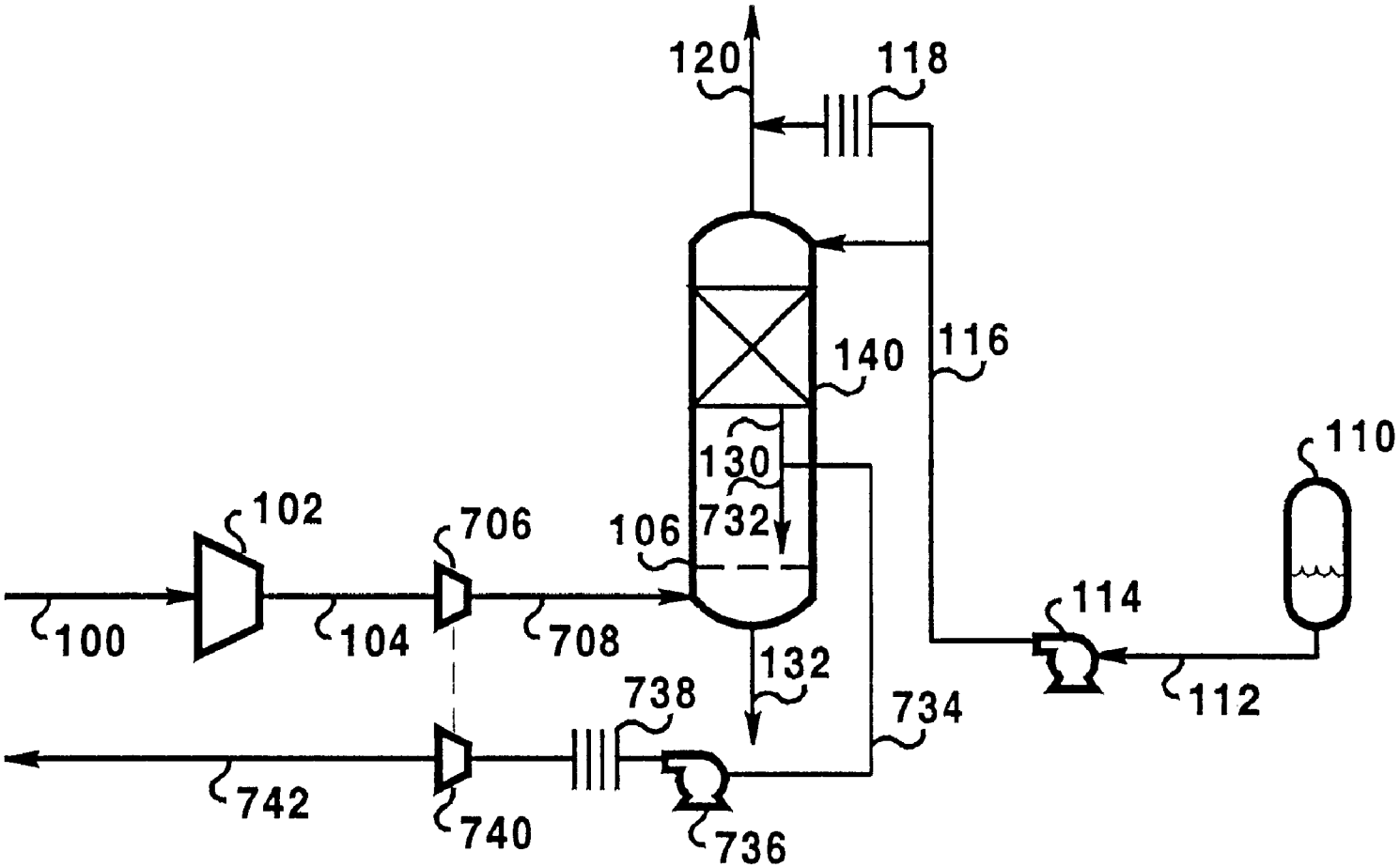
FIG. 7 is a schematic diagram of a seventh embodiment of the present invention.

FIG. 7 illustrates another embodiment of the invention having one of many possible power recovery options. Cryogenic liquid stream 734, a portion of the first oxygen-enriched liquid stream 130 produced in the distillation zone of the distillation column 140, is pumped to a higher pressure in a pump 736, vaporized and warmed in a second vaporizer 738, and expanded in an expander 740 to produce stream 742. Nitrogen-containing gas stream 104 is further compressed in a second compressor 706 to produce stream 708 which is eventually introduced to distillation column 140. Pump 736 is optional. The type of vaporizer used may include, but is not limited to, an ambient or water bath vaporizer. Another source of heat may be employed to further preheat the feed to the expander 740. Power from the expander may be at least partially recovered in a generator (not shown). If a generator is used, then the second compressor 706 becomes optional. Expander 740 may directly or indirectly drive the second compressor 706, supplying at least a portion of the power for the second compressor.

The second compressor 706 may also be used upstream of compressor 102 or in any other compression service, such as compressing cold or warm nitrogen-enriched vapor product stream 120. Recovered power also can be used to drive pumps. Power may be generated by vaporizing and expanding any cryogenic liquid within the process.

The comments below apply to all of the embodiments which are discussed above and illustrated in FIGS. 1–7.

The nitrogen-containing gas steam 100 can come from any source, which may include, but is not limited to, atmospheric air, a customer's compressed air system, a customer's compressed dry air system, or compressed air bottles. Stream 100 may be a nitrogen-containing stream having a different composition than atmospheric air. Similarly, the nitrogen-rich liquid stream 112 can come from any source, which may include, but is not limited to, a liquid tanker trailer. Pump 114 is not needed if the nitrogen-rich liquid stream is at sufficient pressure to be introduced into the distillation column 140.

The distillation column 140 may be an addition to an existing liquid nitrogen vaporization system.

The nitrogen-enriched vapor product may be supplied cold, or it may be warmed to a desired temperature in another device not shown in the figures. The nitrogen-enriched vapor product may be further compressed or expanded.

In general, there is no need to exchange heat between the nitrogen-enriched vapor product and the nitrogen-containing gas. However, cold or partially warmed nitrogen-enriched vapor product can be used to chill the nitrogen-containing gas to some temperature at which the contaminants would not freeze out. If the bulk of water is removed, as shown in FIG. 4, a colder temperature can be achieved.

Any combination of devices described above can be used. For example, the compressed nitrogen-containing gas stream 104 may go through a prepurifier 408, such as shown in FIG. 4, prior to being introduced to a vessel 308, such as shown in FIG. 3. Any other product originating in the cryogenic distillation column, such as oxygen-enriched liquid, can be utilized in another process or device instead of being discarded. For example, it can be shipped to an air separation unit.

EXAMPLE

Table 1 contains a numerical example corresponding to the embodiment of the invention shown in FIG. 1.

TABLE 1

| | Stream No. | Unit | Value |
|---|---|---|---|
| GAN requirement | 120 | SCFH | 100 |
| GAN pressure | 120 | psia | 80 |
| GAN purity | 120 | ppm O2 | 1 |
| LIN required | 116 | SCFH | 71 |
| AIR required | 100 | SCFH | 43 |
| LIN savings | | SCFH | 29 |

The example shows that, at the above conditions, the process of the present invention saves approximately 29% of nitrogen-rich liquid that otherwise would have to be vaporized to generate the required product.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed is:

1. A process for producing a nitrogen-enriched vapor product from a supply of a nitrogen-rich liquid, said process using a purifying device and a distillation column having a distillation zone, comprising the steps of:

feeding at least a portion of the supply of the nitrogen-rich liquid to the distillation zone at a first location;

feeding a stream of a gas containing nitrogen and at least one contaminant to the purifying device, wherein the gas is cooled by a cryogenic liquid whereby at least a portion of the at least one contaminant condenses, solidifies, or dissolves;

eventually feeding at least a portion of the cooled gas from the purifying device to the distillation zone at a second location below the first location;

withdrawing a stream of the nitrogen-enriched vapor product from the distillation zone; and withdrawing a stream of an oxygen-enriched liquid from the distillation zone.

2. A process as in claim 1, wherein at least a portion of the cryogenic liquid is at least a portion of the stream of the oxygen-enriched liquid.

3. A process as in claim 1, wherein the purifying device is located inside the distillation column.

4. A process as in claim 1, wherein the purifying device is located outside the distillation column.

5. A process as claim 1, wherein the gas containing nitrogen comprises air.

6. A process as in claim 1, wherein the gas containing nitrogen has a composition different than a composition of atmospheric air.

7. A system for producing a nitrogen-enriched vapor product from a supply of a nitrogen-rich liquid, comprising:

a means for containing the supply of the nitrogen-rich liquid;

a distillation column having a distillation zone inside the distillation column;

a purifying device in fluid communication with the distillation column;

a means for feeding at least a portion of the supply of the nitrogen-rich liquid to the distillation zone at a first location;

a supply of a gas containing nitrogen and at least one contaminant;

a means for eventually feeding a stream of the supply of the gas to the purifying device, wherein the gas is cooled by a cryogenic liquid whereby at least a portion of the at least one contaminant condenses, solidifies, or dissolves;

a means for withdrawing a stream of the nitrogen-enriched vapor product from the distillation zone; and a means for withdrawing a stream of an oxygen-enriched liquid from the distillation zone.

8. A system as in claim 7, wherein at least a portion of the cryogenic liquid is at least a portion of the stream of the oxygen-enriched liquid.

9. A system as in claim 7, wherein the purifying device is located inside the distillation column.

10. A system as in claim 7, wherein the purifying device is located outside the distillation column.

11. A system as in claim 7, wherein the gas containing nitrogen comprises air.

12. A system as in claim 7, wherein the gas containing nitrogen has a composition different than a composition of atmospheric air.

* * * * *